United States Patent [19]

Perreau et al.

[11] Patent Number: 4,560,167

[45] Date of Patent: Dec. 24, 1985

[54] DEVICE FOR TRAINING TO PLAY GOLF

[75] Inventors: Alain P. Perreau, Compiegne; Jean-Louis Perreau, Rocquencourt, both of France

[73] Assignee: Sidinter S.A., Compiegne, France

[21] Appl. No.: 579,076

[22] Filed: Feb. 10, 1984

[30] Foreign Application Priority Data

Feb. 11, 1983 [FR] France ..... 83 02211

[51] Int. Cl.[4] ..... A63B 69/36; A63B 57/00

[52] U.S. Cl. ..... 273/184 A; 273/181 H; 273/177 R

[58] Field of Search ..... 273/17 L, 17 B, 17 FA, 273/34 R, 177 R, 181 H, 183 R, 183 A, 118 A, 127 R, 127 B, 186 R

[56] References Cited

U.S. PATENT DOCUMENTS

| | | | |
|---|---|---|---|
| 2,263,727 | 11/1941 | Gensburg | 273/118 A |
| 2,894,754 | 7/1959 | Simjian | 273/185 R |
| 3,051,485 | 8/1962 | Heilbrun | 273/54 D |
| 3,145,025 | 8/1964 | Morrison et al. | 273/54 D |
| 4,006,907 | 2/1977 | Russell | 273/185 A |
| 4,171,812 | 10/1979 | Marsin | 273/185 R |
| 4,304,406 | 12/1981 | Cromarty | 273/186 R |
| 4,344,624 | 8/1982 | Laursen | 273/176 F |

FOREIGN PATENT DOCUMENTS

| | | |
|---|---|---|
| 1602679 | 10/1979 | United Kingdom . |
| 2073598 | 11/1980 | United Kingdom . |

*Primary Examiner*—Richard C. Pinkham
*Assistant Examiner*—Vincent A. Mosconi
*Attorney, Agent, or Firm*—Cushman, Darby & Cushman

[57] ABSTRACT

The present invention relates to a device for training to play golf. Above a black disc is coaxially held a detector comprising a phototransistor which monitors a surface of diameter equal to that of a golf hole less the diameter of a golf ball and which sends to an electronic circuit any variation of light due to the passage of a golf ball, this electronic circuit measures the duration of this variation, comparing it with a predetermined duration and signalling the probability of this ball dropping into a golf hole or passing above it or to the side.

7 Claims, 3 Drawing Figures

DEVICE FOR TRAINING TO PLAY GOLF

The present invention relates to a device for training to play golf in a reduced space and which furnishes in figures an objective assessment of the skill of the player in causing the ball to enter a hole.

A device according to the invention comprises a disc whose diameter is equal to that of a golf hole, in a colour which creates a contrast with the colour of the balls used, placed horizontally during use; a means for monitoring this disc is mounted above said disc, at a determined distance therefrom, this means comprising an electronic component sensitive to the light reflected from the disc and a protector against the parasitic light rays coming from the environment. This electronic component is connected to an electronic circuit adapted to analyze the variation of the reflected light received by this component and to translate it into probability of entrance of the ball into the fictitious hole represented by the disc or of its passage above or to the side of this fictitious hole.

The electronic component and the protector are preferably disposed above the disc so as to monitor only a part of the surface of the latter, for example a central zone of diameter equal to that of the disc less the diameter of a golf ball.

In a preferred embodiment of the invention, the electronic component is a phototransistor and the protector is an element of generally truncated section having an opening and a bottom where the phototransistor is placed, the front part of this element having successive internal steps whose diameters decrease up to the diameter of the rear part which is cylindrical.

The electronic circuit comprises a quadruple comparator followed by a pulse generator supplying a sound or visual indicator apparatus.

The disc is generally black and matt, which is unfavourable to the parasitic reflexions of the surrounding light, and the balls are white or yellow, possibly fluorescent.

The passage of a golf ball over the disc is translated by an increase in the light received by the phototransistor during passage of this ball in the field defined by the protector.

The duration of this increase is measured by the electronic circuit and compared with a determined value.

If this duration is less than said latter value, the device considers that the ball has passed too quickly or too close to the edge to be able to drop into the hole and the indicator apparatus emits a first signal. If this duration is greater than said predetermined value, the device considers that the ball has passed at a suitable, fairly slow speed at the centre or edge of the hole for it to drop into said hole. The indicator apparatus emits a second signal.

The electronic circuit preferably comprises a means for adjusting the determined value of comparison, for example in a range of 25 ms to 95 ms, the preferred value being 65 ms.

The invention will be more readily understood on reading the following description with reference to the accompanying drawings, in which.

Figure 1:
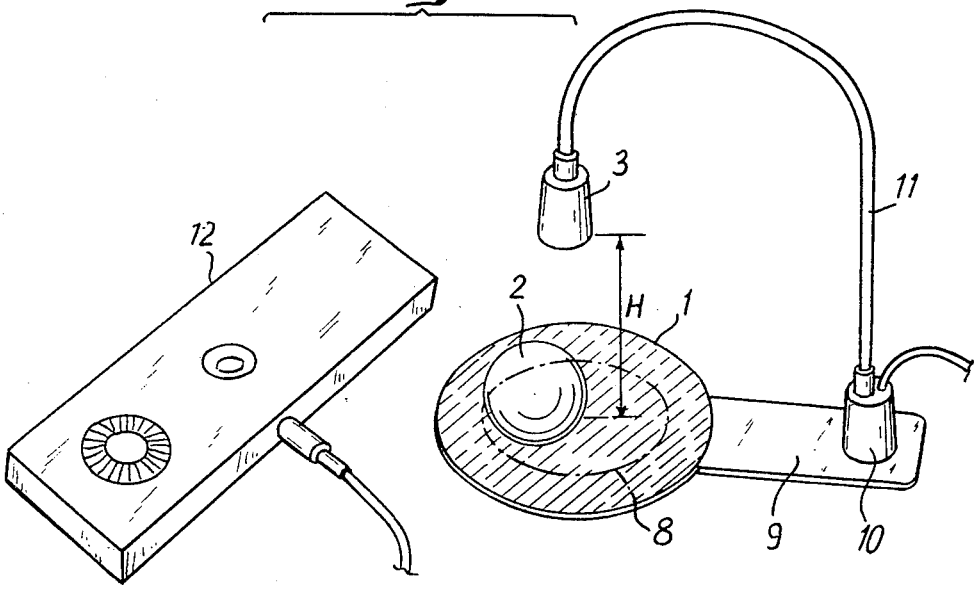
FIG. 1 is a general view in perspective of a device according to the invention.

Referring now to the drawings, a device according to the invention comprises a thin disc 1 adapted to be placed on the ground, having a diameter equal to that of a golf hole, viz. 108 mm, and a surface whose colour is unfavourable to the reflexion of light, preferably black and matt, which creates a contrast with the colour of the golf balls 2 which are generally white. It is possible, within the scope of the invention, to use white or yellow balls, possibly phosphorescent or fluorescent.

Figure 3:
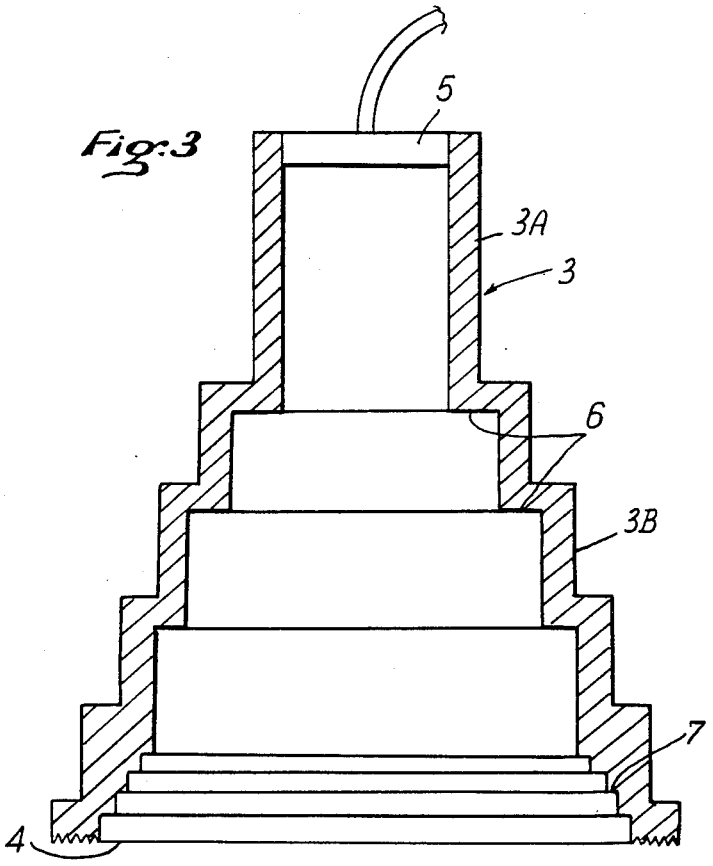
FIG. 3 is an enlarged view in detail in section through a plane passing through the axis of the protector forming part of the device of FIG. 1.

Above the disc 1, at a determined distance H, a protector 3 which is more readily seen in FIG. 3, is installed coaxially to this disc 1. This protector 3 has a front part with an opening 4 directed towards the disc 1 and a rear part with a bottom constituted by a phototransistor 5. The rear part 3A is preferably cylindrical, whilst the front part 3B widens on approaching the opening 4 thanks to a succession of successive internal steps 6 of increasing diameters, which are three in number in FIG. 3. In this way, the cylindrical rear part 3A having a length equal to about $\frac{1}{3}$ of the total length, the protector 3 is generally truncated in section.

The entrance 4 is limited by an outwardly flared surface 7 in which a plurality of successive steps are also provided.

These arrangements are made to prevent as much as possible any parasitic ray of light from penetrating to the bottom of the protector 3 and from striking the phototransistor 5.

The height H, the length and the diameter of the protector 3 are selected so that the phototransistor 5 monitors on the disc 1 a narrower surface indicated by a circle 8 in chain-dotted lines, having a diameter of 86 mm, viz. the diameter of the disc 1 less the diameter of a golf ball. Of course, the height H also depends on the sensitivity of the electronic component 5 used. With a phototransistor of PLANAR type with wide angle of aperture, as in the present example, the height H was 95 mm.

The disc is advantageously extended outwardly by a radial lateral plate 9 made of magnetic material on which is defined with precision the location of a magnetized stud 10, for example with the aid of centering holes and points (not shown). The magnetized stud 10 serves as base for an incurved tube 11 which terminates above the disc 1 and holds the protector 3 in position coaxially with respect thereto. The tube 11 also serves for the passage of the wires of the phototransistor 5; from the stud 10, the wires lead to a box 12 which contains an electronic circuit and which bears the knobs for controlling the device.

Figure 2:
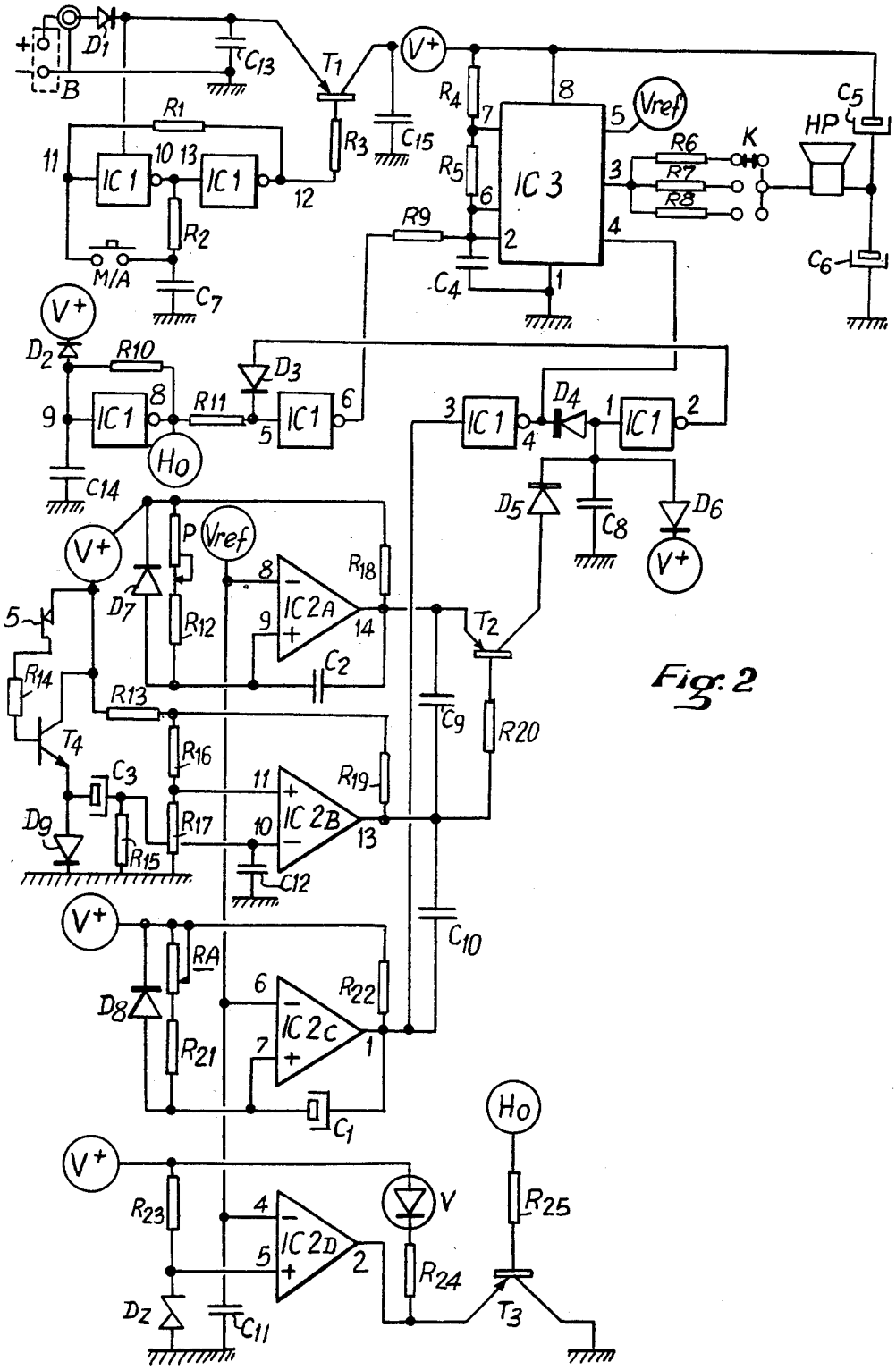
FIG. 2 is a diagram of the electronic circuit of the same device.

The electronic circuit shown schematically in FIG. 2 comprises three integrated circuits IC 1, IC 2 and IC 3. Circuit IC 1 is a multi-gate circuit, available on the market under reference 74 C 14; it is composed of six Schmitt triggers whose principal functions are: switching on the circuit; switching off the circuit, the generation of two tones for the two sound signals described above. Circuit IC 2 is a quadruple comparator; it is available on the market under reference LM 339; it comprises a circuit IC 2A which measures the duration of the passage, i.e. the duration of the detection of the ball, a circuit IC 2B which ensures detection of the passage of the ball via any rapid variation of the reflected light received by the phototransistor 5, a circuit IC 2C which fixes the duration of the sound signals and which comprises an adjustable resistor RA, a circuit IC 2D which monitors the voltage of the supply source of the device thanks to a Zener diode D2 and which signals any drop in voltage with the aid of an electroluminescent diode V of high luminosity.

Circuit IC 2A comprises a linear potentiometer P which serves to adjust the duration with which is compared that of the passage of the ball, as has been explained hereinabove.

Circuit IC 3 is a pulse generator comprising an astable multivibrator, available on the market under reference 555, whose principal function is the conversion of D.C. pulses into oscillations.

The production of such a circuit from components available on the market does not present any particular difficulty for the man skilled in the art. It is therefore unnecessary to describe it in greater detail.

However, it will be specified that the phototransistor 5 is mounted as a current source so as to furnish a logarithmic signal. When this signal varies slowly, the comparator circuit adapts itself to the new illumination without emitting any sound, because it is question of a change in the surrounding light or the passage of a shadow. When this signal varies rapidly, it is question of a ball passing over the monitored surface 8 of the disc 1. The comparator circuit emits a continuous sound and measures the duration of the signal. If this duration is less than the fixed value mentioned above, the continuous sound is stopped after a few seconds. If the duration is greater than said value, the circuit emits a sound with two alternate tones, signalling success, i.e. the probability of the ball entering the hole.

What is claimed is:

1. A device for training to play golf, comprising a flat, thin disc of determined diameter substantially equal to that of a golf hole, in a color which creates a contrast with the color of the balls used, placed horizontally during use, a means for monitoring said disc mounted coaxially above said disc, at a predetermined distance therefrom, this monitoring means comprising an electronic component sensitive to the light reflected toward said sensitive component from said disc and connected to an electronic circuit adapted to analyze the variation of the reflected light received wherein said variation is to be caused by the passage of a rolling ball over said disk and to assess the probability of entrance of the ball into a fictitious hole represented by said disc relative to the passage of the ball relative to this fictitious hole said electronic circuit means comprises a circuit for detecting any rapid variation of the reflected light, a circuit for measuring the duration of this variation, a comparator circuit comparing this duration with a predetermined duration and at least one signal emitter, whereby a signal will be emitted corresponding to the passage of a ball relative to said disk and, when said duration is greater than said predetermined duration, indicating the entrance of the ball into said fictitious hole and when said duration is less than said predetermined duration, indicating the failure of the ball to enter the fictitious hole.

2. The device of claim 1, wherein the electronic component sensitive to the reflected light is a phototransistor disposed at the bottom of a hollow protector open in the direction of the disc.

3. The device of claim 2, wherein the hollow protector has a generally truncated section with a cylindrical rear part closed by a bottom where the phototransistor is located and a front part having, from an opening, successive internal steps whose diameters decrease towards that of the rear part.

4. The device of claim 1, wherein the electronic component sensitive to the reflected light is disposed above the disc so as to monitor thereon a central surface having a diameter equal to that of a golf hole less the diameter of a golf ball.

5. The device of claim 1, wherein the electronic circuit comprises a means for adjusting, between 25 ms and 95 ms, the predetermined duration with which is compared the duration of variation of the reflected light further to the passage of the ball.

6. The device of claim 1, wherein the disc is provided with a lateral plate extending radially outwardly, on which is defined the location of a stud serving as base for a curved tube which terminates above the disc and holds the monitoring means coaxially with respect thereto.

7. The device of claim 6, wherein the lateral plate is made of magnetic material and the stud is a magnetized stud.

* * * * *